US006971910B2

(12) United States Patent
Chang et al.

(10) Patent No.: US 6,971,910 B2
(45) Date of Patent: Dec. 6, 2005

(54) ENGAGING DEVICE FOR USE IN USER INTERFACE DEVICE

(75) Inventors: Chin-Jui Chang, Taoyuan (TW); Thomas Chiang, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 10/793,989

(22) Filed: Mar. 5, 2004

(65) Prior Publication Data

US 2004/0175988 A1 Sep. 9, 2004

(30) Foreign Application Priority Data

Mar. 7, 2003 (TW) ..... 92203545 U

(51) Int. Cl.[7] ..... H01R 13/73

(52) U.S. Cl. ..... 439/552; 439/567; 200/296

(58) Field of Search ..... 200/296, 295; 439/552, 567, 571–572, 79–82, 381, 374, 439/378, 83

(56) References Cited

U.S. PATENT DOCUMENTS

| | | | | |
|---|---|---|---|---|
| 2,446,141 | A * | 7/1948 | Parsons | 200/295 |
| 3,453,408 | A * | 7/1969 | Mune | 200/295 |
| 4,678,879 | A * | 7/1987 | Kenway | 200/296 |
| 5,217,190 | A * | 6/1993 | Reed et al. | 439/557 |
| 6,284,991 | B1 * | 9/2001 | Fasano et al. | 200/296 |

* cited by examiner

*Primary Examiner*—P. Austin Bradley
*Assistant Examiner*—Edwin A. Leon
(74) *Attorney, Agent, or Firm*—Volpe and Koenig, P.C.

(57) ABSTRACT

An engaging device for use in a user interface device is provided. The engaging device for use in a user interface device, wherein the user interface includes a main body having a body panel disposed therein, and a case having a panel with a recess therein, the engaging device includes a plurality of engaging elements disposed on the main body for engaging the main body in the recess of the case panel through an engagement between the case panel and the engaging elements, wherein one end of the engaging elements is connected to the main body, the other end thereof is a free end, and the middle portion thereof is bent and protruded for being away from the main body.

4 Claims, 6 Drawing Sheets

ENGAGING DEVICE FOR USE IN USER INTERFACE DEVICE

FIELD OF THE INVENTION

The present invention is related to an engaging device, and more particularly, to an engaging device for use in a user interface device.

BACKGROUND OF THE INVENTION

A user interface is an interface between human beings and machines, which includes hardware and software. The research field of a user interface combines computer science, biology, design art, recognition science and engineering. Recently, with the development of information technology, computer technology, and the network technology, the design and development for the user interface are the most active research in the international computer and design fields.

A successful design is deeply related to the quality of the user interface. Especially when the more related inventive ability and technology are grown up, the more competitors appear in the market. The quality of the user interface is an important indicator for differentiating the product levels.

A user interface can replace the conventional control panel, which can reduce the I/O modules of the programmable logic controller (PLC), buttons, numeral settings, indicating lamps, and can show important massage immediately for users to control the machine accurately. The PLC user interface can store multiple pages. Every page is composed of text, graphic, and predetermined PLC data. The designer can edit various displaying pages for showing the application status, operation indicating, parameter setting, action flow, warning massage, and simple table etc.

Recently, the conventional simple user interface is fixedly disposed in the panel by the screws and nuts. It is difficult to assemble the conventional user interface without proper tools. In fact, it wastes lots of time when it needs to install a number of user interfaces onto the machine or device with screws and nuts. Accordingly, an engaging device that is designed for engaging the user interface is needed in the industry, which allows the user to assemble the user interface device rapidly and precisely without any tools.

SUMMARY OF THE INVENTION

It is the main object of the present invention to provide an engaging device for use in a user interface device.

It is another object of the present invention to provide an engaging device for users to install the user interface device onto the machine panel without any tools.

It is another object of the present invention to provide an engaging device for users to assemble the user interface device rapidly.

According to one aspect of the present invention, the engaging device for use in a user interface device, wherein the user interface includes a main body having a body panel disposed therein, and a case having a case panel with a recess therein, the engaging device includes a plurality of engaging elements disposed on the main body for engaging the main body in the recess of the case panel through an engagement between the case panel and the engaging elements, wherein one end of the engaging elements is connected to the main body, the other end thereof is a free end, and the middle portion thereof is bent and protruded for being away from the main body.

Preferably, the main body is a body of the user interface device.

Preferably, the engaging elements are disposed around the main body.

Preferably, the engaging elements are parts of the main body.

Preferably, each the engaging elements has a structure of curvy-strip type.

Preferably, the free end has a sawtooth structure.

Preferably, the engaging elements provide an elastic force in response to a press.

According to another aspect of the present invention, the user interface device with an engaging device includes a main body having a panel and a plurality of engaging slots; a case having a case panel with a recess for engaging the main body; and a plurality of engaging elements for engaging with the plurality of engaging slots, wherein the main body is engaged in the recess of the case panel through an engagement among the case panel, the engaging slots and the engaging elements.

Preferably, each of the engaging elements includes an engaging portion and a pressing portion.

Preferably, each of the engaging slots has sawteeth at two sides thereof.

Preferably, each end of the engaging portion further includes a claw for engaging with the sawteeth of the engaging slots.

Preferably, the main body is engaged in the recess of the case panel through an engagement between the case panel and the pressing portion.

Preferably, each of the engaging slots includes a receiving room for receiving the engaging element.

Preferably, each of the engaging slots further includes a positioning strip.

Preferably, each of the engaging elements further includes a channel in the center thereof.

Preferably, the engaging elements move along a direction of the channel by an interaction between the positioning strip and the channel.

Preferably, each of the engaging elements includes an opening for providing an elastic force in response to a press.

The foregoing and other features and advantages of the present invention will be more clearly understood through the following descriptions with reference to the drawings, wherein:

DETAILED DESCRIPTION OF THE PREFERRED EMBODIMENT

Figure 1:
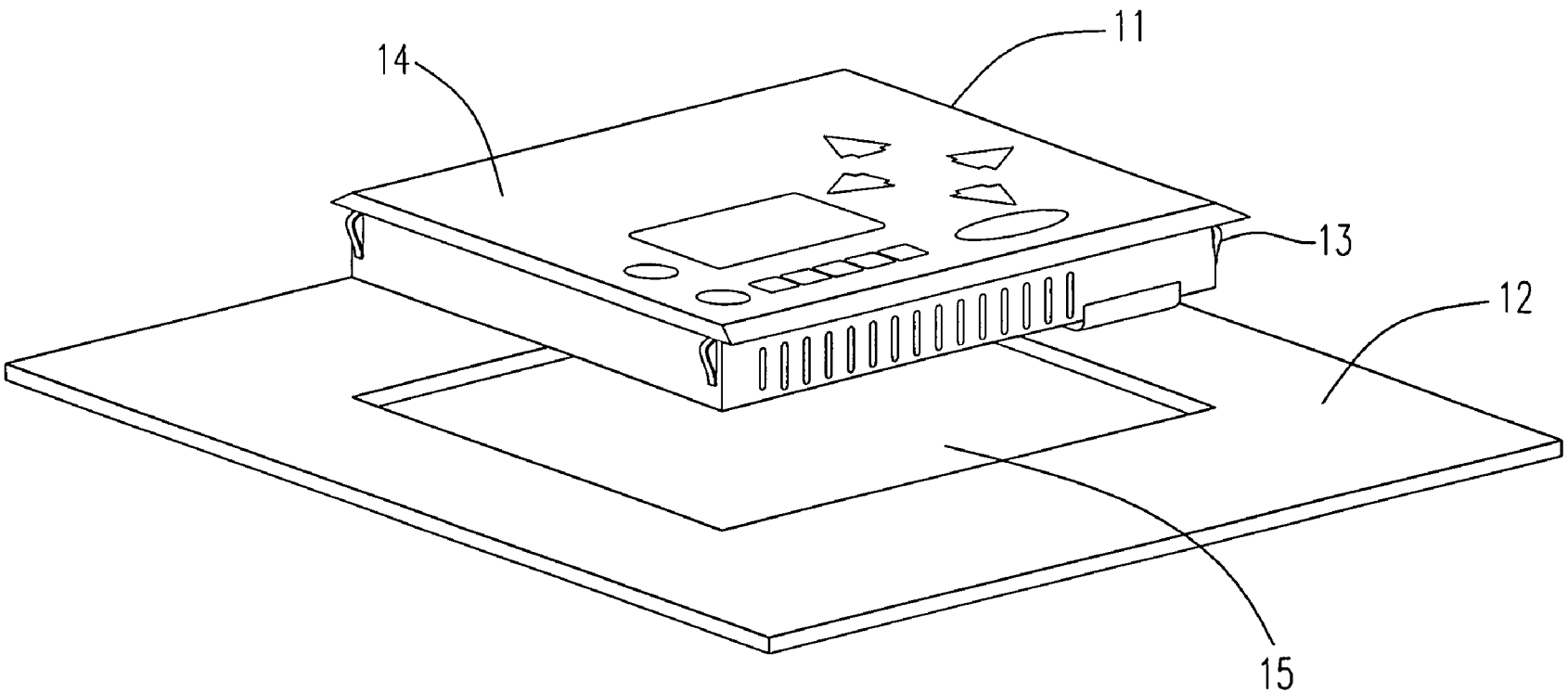
FIG. 1 illustrates a structural view of the engaging device for use in a user interface device according to a preferred embodiment of the present invention.

The present invention will now be described more specifically with reference to the following embodiment. Please refer to FIG. 1. FIG. 1 illustrates a structural view of the engaging device for use in a user interface device according to a preferred embodiment of the present invention. The user interface includes the main body 11 and a case (not shown). The main body 11 has the body panel 14 disposed therein, and the case (not shown) has the case panel 12 with the recess 15 therein. Meanwhile, the engaging device includes a plurality of engaging elements 13 which are disposed on the main body 11. The engaging elements 13 engage the main body 11 in the recess 15 of the case panel 12 through an engagement between the case panel 12 and the engaging elements 13.

Figure 2:
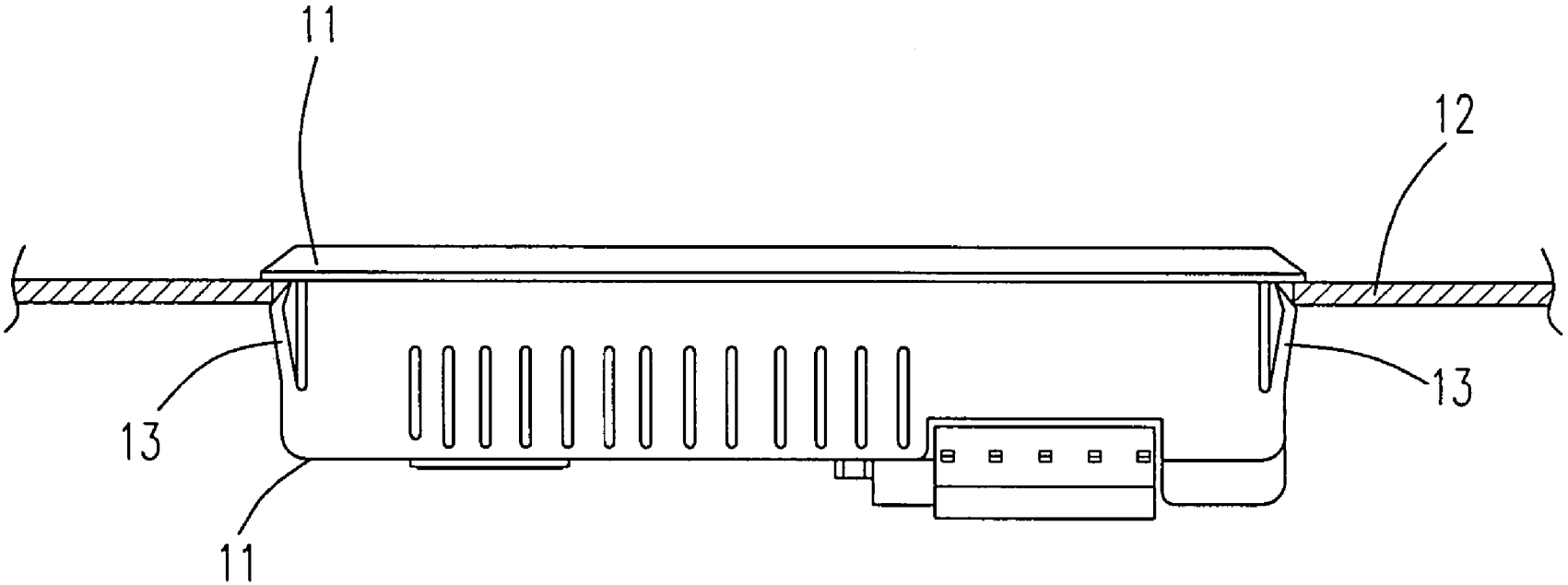
FIG. 2 illustrates a side view of the engaging device for use in a user interface device according to a preferred embodiment of the present invention.

Please refer to FIG. 2. The engaging elements 13 are disposed around the main body 11 for being parts of the main body 11. The engaging elements 13 provide an elastic force in response to a press for engaging the main body 11 with the case panel 12. Each engaging element 13 has a structure of curvy-strip type. One end of the engaging elements 13 is connected to the main body 11, the other end thereof is a free end, and the middle portion thereof is bent and protruded for being away from the main body 11. For engaging the main body 11 with the case panel 12 firmly, the engaging element 13 has a free end.

Figure 3:
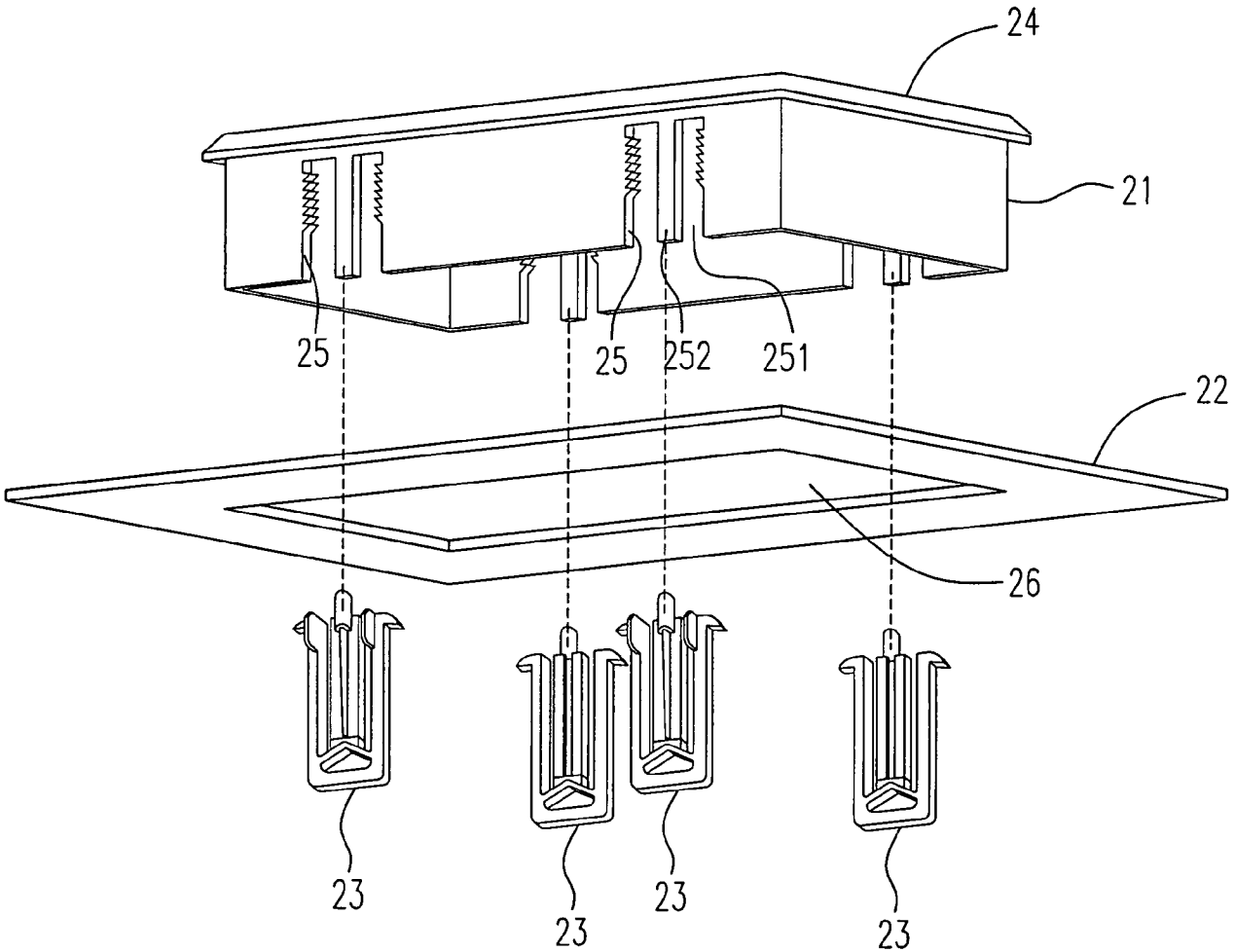
FIGS. 3–4 illustrate a structural view of the engaging device for use in a user interface device according to another preferred embodiment of the present invention.
Figure 4:
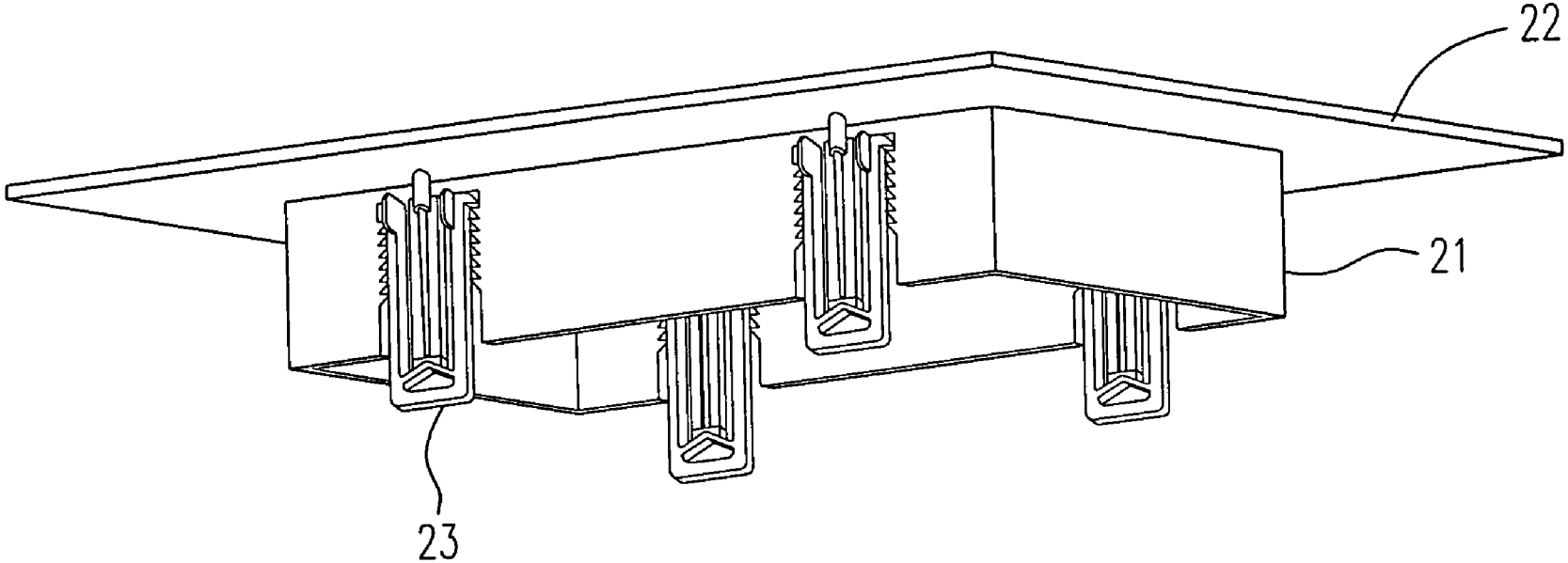
Figure 5C:
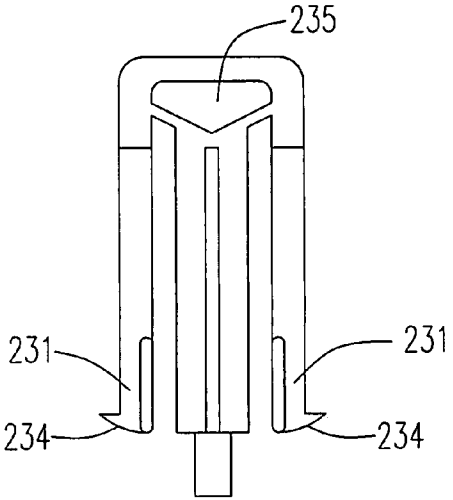
FIGS. 5*a*–5*e* illustrate front, side, back, end, and perspective structural views, respectively of the engaging elements according to a preferred embodiment of the present invention.
Figure 5B:
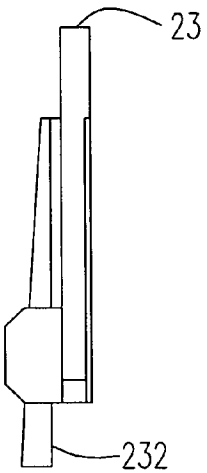
Figure 5A:
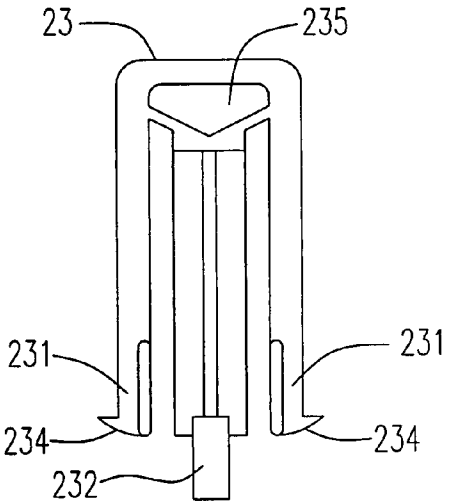
Figure 5E:
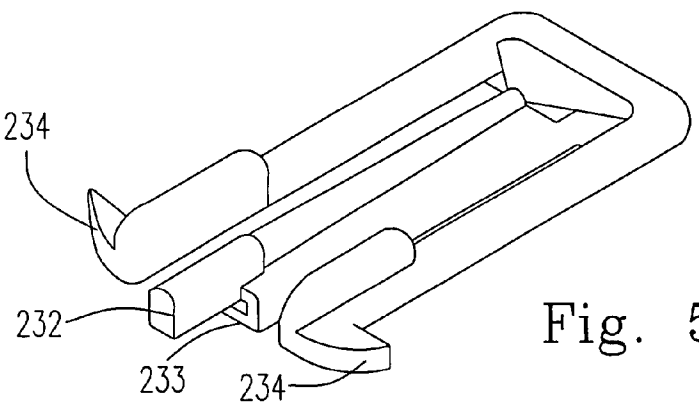
Figure 5D:
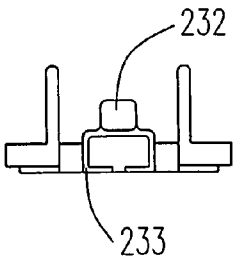

Please refer to FIGS. 3 and 4. The user interface device with an engaging device includes the main body 21; a case (not shown) having the panel 22 with the recess 26; and a plurality of engaging elements 23. The main body 21 has a panel 24 and a plurality of engaging slots 25. The recess 26 is also used for engaging the main body 21. The plurality of engaging elements 23 is for engaging with the plurality of engaging slots 25. Referring to FIGS. 3–4, the main body 21 is engaged in the recess 26 of the case panel 22 through an engagement among the case panel 22, the engaging slots 25 and the engaging elements 23. Each of the engaging slots 25 includes the receiving room 251 for receiving the engaging element 23. Meanwhile, each of the engaging slots 25 further includes the positioning strip 252.

Figure 6:
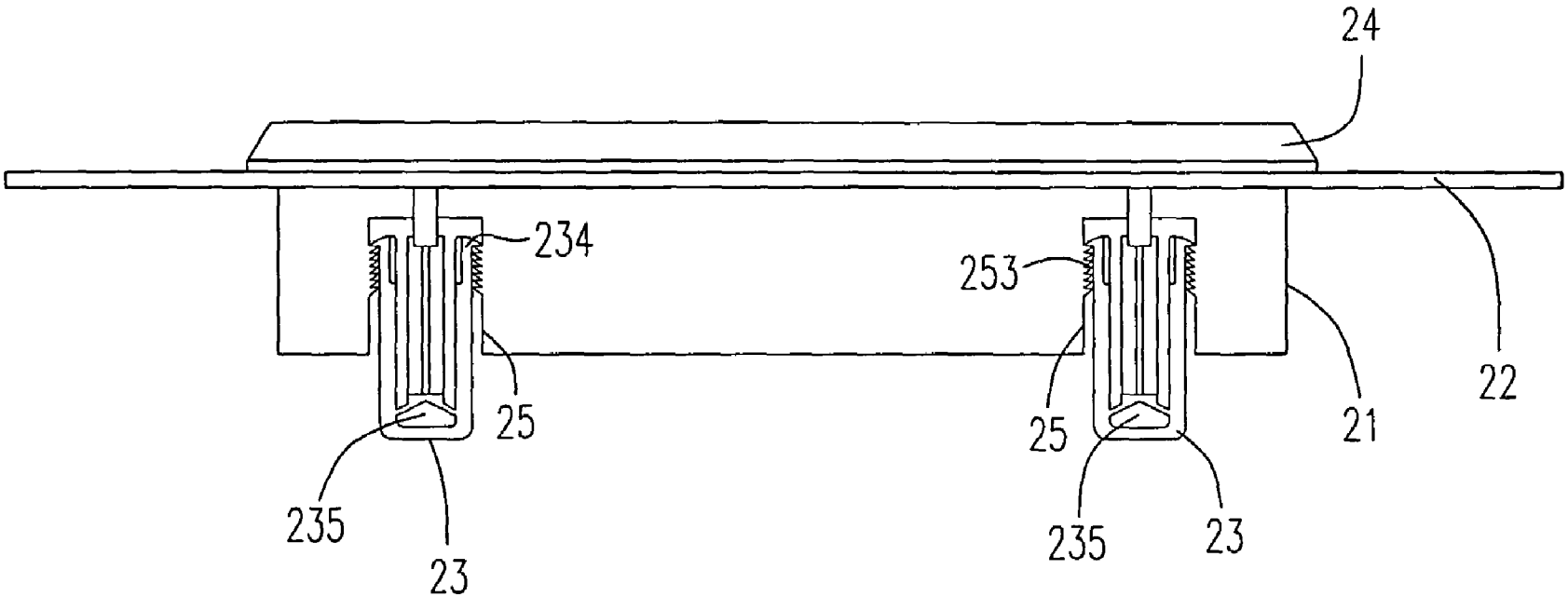
FIG. 6 illustrates a side view of the engaging device for use in a user interface device according to another preferred embodiment of the present invention.

Please refer to FIGS. 5(*a*)–(*e*). Each of the engaging elements 23 includes the engaging portion 231, the pressing portion 232 and the channel 233. The engaging elements move along a direction of the channel 233 by an interaction between the positioning strip 252 and the channel 233. Please refer to FIG. 6. Each end of the engaging portion 231 further includes a claw 234 for engaging with the sawteeth 253 of the engaging slots 25. In addition, each of the engaging elements 23 includes the opening 235 for providing an elastic force in response to a press. Accordingly, the main body 21 is engaged in the recess 26 of the case panel 22 through an engagement between the case panel 22 and the pressing portion 232.

According to the above, without the proper tools, i.e. bolts and nuts, the conventional engaging device for use in a user interface device is difficult to assemble. Also, it is hard to install the user interface device rapidly in a limited period. On the contrary, the engaging device according to the present invention not only has a good shape, but also can be assembled onto the user interface device without using any tools, which can be assembled rapidly. Therefore, it can improve the speed of assembly and eliminate the drawbacks of the prior device.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation, so as to encompass all such modifications and similar structures. Accordingly, the invention is not limited by the disclosure, but instead its scope is to be determined entirely by reference to the following claims.

What is claimed is:

1. A user interface device with an engaging device, comprising:

a main body having a panel and a plurality of engaging slots, wherein each of said engaging slots has sawteeth at two sides thereof;

a case having a case panel with a recess for engaging said main body; and a plurality of engaging elements for engaging with said plurality of engaging slots, wherein each of said engaging elements comprises an engaging portion and a pressing portion and said main body is engaged in said recess of said case panel through an engagement among said case panel, said engaging slots and said engaging elements.

2. The device according to claim 1, wherein each end of said engaging portions further comprises a claw for engaging with said sawteeth of said engaging slots.

3. The device according to claim 1, wherein each of said engaging elements comprises an opening, so that an elastic force is formed in response to a press applied on said engaging element.

4. A user interface device with an engaging device, comprising:

a main body having a panel and a plurality of engaging slots;

a case having a case panel with a recess for engaging said main body; and a plurality of engaging elements for engaging with said plurality of engaging slots, wherein said main body is engaged in said recess of said case panel through an engagement among said case panel, said engaging slots and said engaging elements, each of said engaging slots comprises a receiving room for receiving said engaging element and a positioning strip, each of said engaging elements further comprises a channel in a center thereof, and said engaging elements move along a direction of said channel by an interaction between said positioning strip and said channel.

* * * * *